US008689557B2

(12) United States Patent
Maki et al.

(10) Patent No.: US 8,689,557 B2
(45) Date of Patent: Apr. 8, 2014

(54) STEAM SEAL DUMP RE-ENTRY SYSTEM

(75) Inventors: William Eric Maki, Schenectady, NY (US); Kevin J. Odell, Rensselaer, NY (US); Michael James Molitor, Schenectady, NY (US); Timothy Andrew Melsert, Schenectady, NY (US); Steven Paul Scarlata, Wynantskill, NY (US); James Daniel Antalek, Schenectady, NY (US)

(73) Assignee: General Electric Company, Schenectady, NY (US)

( * ) Notice: Subject to any disclaimer, the term of this patent is extended or adjusted under 35 U.S.C. 154(b) by 318 days.

(21) Appl. No.: 13/021,039

(22) Filed: Feb. 4, 2011

(65) Prior Publication Data

US 2012/0198845 A1 Aug. 9, 2012

(51) Int. Cl.
*F01K 7/34* (2006.01)

(52) U.S. Cl.
USPC ..... 60/653; 60/677

(58) Field of Classification Search
USPC ..... 60/645, 653, 677, 679, 646, 657
See application file for complete search history.

(56) References Cited

U.S. PATENT DOCUMENTS

| | | | | |
|---|---|---|---|---|
| 3,393,436 | A | 7/1968 | Blackhurst et al. | |
| 3,544,233 | A * | 12/1970 | Brown et al. | 415/126 |
| 3,959,973 | A | 6/1976 | Meylan | |
| 4,357,803 | A * | 11/1982 | Dickenson | 60/662 |
| 4,372,125 | A * | 2/1983 | Dickenson | 60/660 |
| 4,541,247 | A * | 9/1985 | Martin | 60/660 |
| 4,859,076 | A * | 8/1989 | Twerdochlib | 374/10 |
| 5,860,787 | A | 1/1999 | Richards | |
| 6,238,180 | B1 | 5/2001 | Magoshi et al. | |
| 6,984,108 | B2 | 1/2006 | Anderson et al. | |
| 8,221,056 | B2 * | 7/2012 | Hofer | 415/116 |

FOREIGN PATENT DOCUMENTS

| | | |
|---|---|---|
| CN | 101008328 | 8/2007 |
| DE | 10 2008 045 655 | 4/2010 |

OTHER PUBLICATIONS

Chinese Office Action dated Aug. 21, 2013 issued in Chinese Patent Application No. 200910133443.7, 12 pp.
French Search Report dated Aug. 27, 2013 issued in French Patent Application No. 12 50972, 5 pp.

* cited by examiner

*Primary Examiner* — Kenneth Bomberg
*Assistant Examiner* — Wesley Harris
(74) *Attorney, Agent, or Firm* — Nixon & Vanderhye P.C.

(57) ABSTRACT

A steam seal dump re-entry system delivers steam dump flow to an LP steam turbine. The system includes a steam seal header receiving steam leaking from turbine end seal packings, and a desuperheater receiving and cooling the steam from the steam seal header. The desuperheater outputs cooled steam. A temperature sensor is disposed downstream of the desuperheater and detects a temperature of the cooled steam. A flow control circuit communicating with the temperature sensor selectively delivers the cooled steam to at least one of the condenser and to the LP steam turbine depending on the temperature of the cooled steam.

4 Claims, 2 Drawing Sheets

STEAM SEAL DUMP RE-ENTRY SYSTEM

BACKGROUND OF THE INVENTION

The invention relates to steam turbines and, more particularly, to a system utilizing dump flow to achieve a performance gain by dumping the steam seal flow back into the turbine.

Thermal power plants such as steam turbines have boilers that burn fuel to make heat. In a power plant, heat energy is conducted into metal pipes, heating water in the pipes until it boils into steam. This steam is fed under high pressure to the turbine. The turbine includes various sections operating at different pressures, including a high pressure section (HP section), an intermediate pressure section (IP section), and a low pressure section (LP section).

In existing machines, steam leaking from the turbine end seal packings is plumbed into a steam seal header. Steam seal leakage increases over time as the end packing teeth wear. After start-up, the machines will self-seal and have a dump flow. In a typical design, the dump flow steam is dumped to the condenser. A performance gain may be realized by dumping the steam seal flow back into the turbine as the steam can expand and do work in the LP section of the turbine.

In a previous design, steam dump flow was routed into the LP turbine. The dump flow, however, is too hot for the LP turbine components, resulting in thermal distortion in the LP hood and diaphragms, which can lead to vibration issues and decreasing performance.

It would be desirable to provide a system that enables steam seal dump re-entry by cooling the steam prior to entering the turbine.

BRIEF DESCRIPTION OF THE INVENTION

In an exemplary embodiment, a steam seal dump re-entry system is provided for delivering steam dump flow to a condenser or an LP steam turbine. The system includes a steam seal header receiving steam leaking from turbine end seal packings, and a desuperheater receiving and cooling the steam from the steam seal header. The desuperheater outputs cooled steam. A temperature sensor is located downstream of the desuperheater and detects a temperature of the cooled steam. A flow control circuit communicating with the temperature sensor selectively delivers the cooled steam to at least one of the condenser and the LP steam turbine depending on the temperature of the cooled steam.

In another exemplary embodiment, a method for delivering steam dump flow to a condenser or an LP steam turbine includes the steps of (a) initially routing the steam dump flow to the condenser; (b) when a first predetermined permissive is met, cooling the steam dump flow in a desuperheater, the desuperheater outputting cooled steam; (c) after step (b), routing the cooled steam to the condenser until a temperature of the cooled steam is stable; and (d) when a second predetermined permissive is met, routing the cooled steam to the LP turbine.

In still another exemplary embodiment, a steam seal dump re-entry system includes a steam seal header receiving steam leaking from turbine end seal packings; a dump valve in fluid communication with the steam seal header; a condensate supply; and a desuperheater receiving the steam from the steam seal header via the dump valve and receiving condensate from the condensate supply via a control valve. The desuperheater outputs cooled steam. A temperature sensor downstream of the desuperheater detects a temperature of the cooled steam. The temperature sensor communicates with the control valve, and the control valve controls an amount of the condensate delivered to the desuperheater depending on a signal from the temperature sensor. A flow control circuit communicating with the temperature sensor selectively delivers the cooled steam to at least one of the condenser and the LP steam turbine depending on the temperature of the cooled steam.

DETAILED DESCRIPTION OF THE INVENTION

The described embodiments relate to a steam seal dump re-entry system designed to cool the steam prior to entering the LP turbine. The system includes a radial spray attemperator or desuperheater that reduces the steam temperature by bringing the superheated steam into direct contact with condensate pulled off the main condensate line. Control components control delivery of the steam dump flow to the LP turbine when predetermined permissives have been met. The system determines whether any of the permissives are lost during operation, upon which the system will divert the dump flow back to the condenser to protect the turbine.

Figure 1:
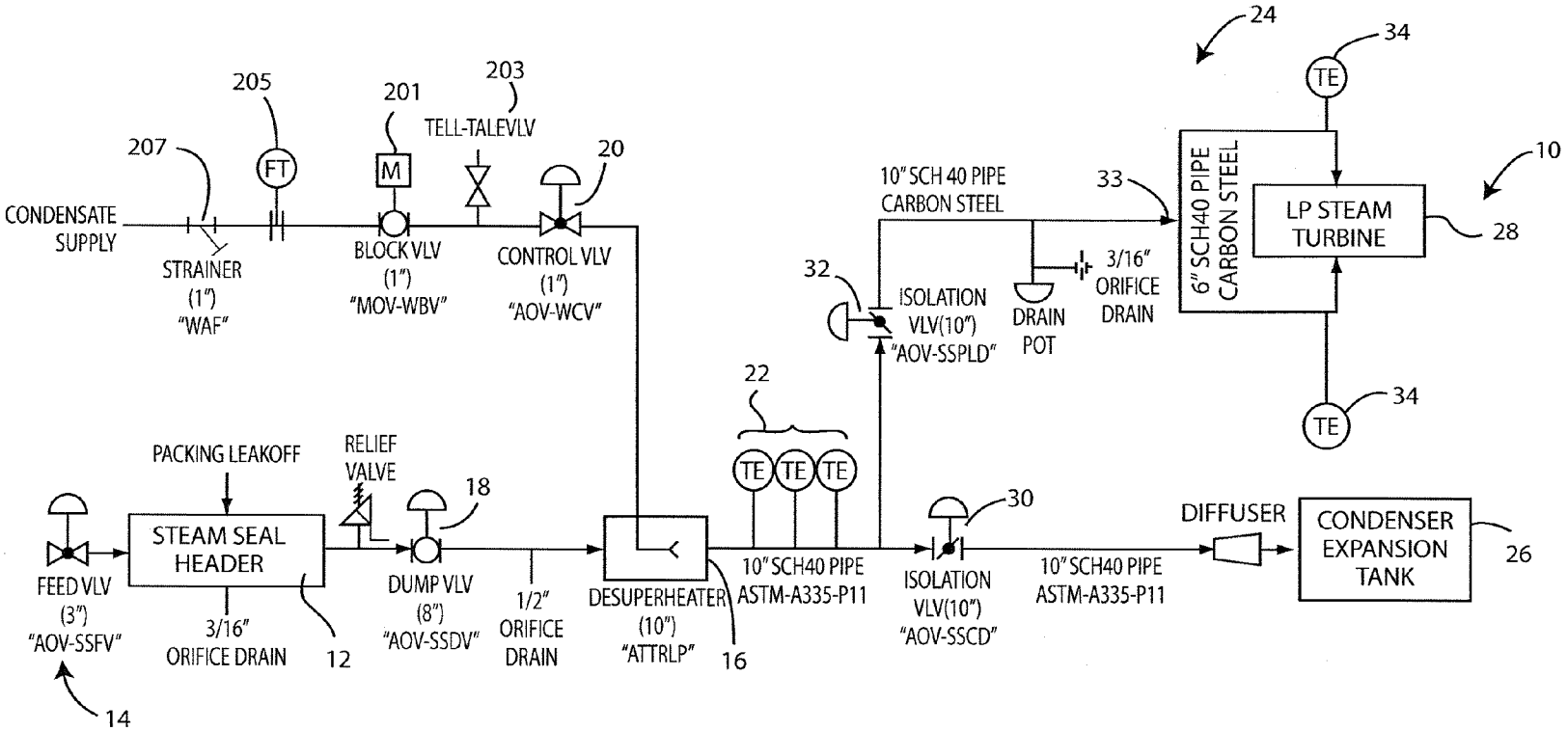
FIG. 1 is a schematic diagram of the steam seal dump re-entry system.

FIG. 1 is a schematic illustration of the steam seal dump re-entry system 10. Steam leaking from the turbine end seal packings is plumbed into a steam seal header 12. As with all machines, when the turbine is up to speed, it will self-seal and have a dump flow. Before the system achieves self-sealing, steam may be added to the steam seal header 12 via a feed valve 14. As noted above, in a typical turbine, the dump steam is directed to the condenser 26. The present system 10 endeavors to cool the dump flow and direct the cooled steam back into the turbine 28 as this steam can expand and do work in the LP turbine.

To provide cooling, the steam from the steam seal header 12 is directed to a desuperheater 16 via a dump valve 18. A condensate supply is pulled off the main condensate line and is directed to the desuperheater via a control valve 20. Preferably, a maximum temperature of the condensate is about 100° F. The control valve 20 meters the condensate to the desuperheater 16. By bringing the steam from the steam seal header 12 into direct contact with the condensate in the desuperheater 16, a temperature of the steam can be reduced to a temperature suitable for input into the LP turbine 28. For example, the dump flow from the steam seal header 12 may be about 900° F., and the amount of condensate mixed with the steam in the desuperheater 16 should cool the steam to about 350° F.

Between the condensate supply and the control valve 20, a motorized block valve 201 is closed any time the control valve 20 is closed. The block valve 201 is used to prevent water leaking past the control valve (prone to wear) and collecting in the pipeline. It is a second line of defense. The block valve 201 is automatically closed below a predetermined minimum load. A tell-tale valve 203 is a manually operated drain valve that is installed between the block valve 201 and the control valve 20. This connection can be used as a "tell-tale" for testing block valve leakage. A flow transmitter 205 checks for condensate flow past the block 201 and control 203 valves (and will trigger an alarm if flow is detected when the block valve 201 is closed). The flow transmitter 205 also measures condensate flow rate during normal operation. A strainer 207 serves to remove debris from the condensate supply line that could clog the desuperheater nozzles.

A temperature sensor 22 is positioned downstream of the desuperheater 16 and detects a temperature of the cooled steam. As shown, the temperature sensor 22 may include a series of thermocouples to increase the reliability of the temperature measurement. The temperature sensor 22 communicates with the control valve 20 to regulate the condensate supplied to the desuperheater 16 and thereby control a temperature of the steam exiting the desuperheater 16. The temperature sensor 22 also determines when a temperature of the steam exiting the desuperheater 16 is stabilized. In this context, if the temperature remains too high, it is prevented from being delivered to the LP turbine 28 to prevent thermal distortion and poor performance. Similarly, if the temperature is too low, the steam is also prevented from being delivered to the LP turbine 28 to prevent putting water droplets in the LP turbine.

The delivery of the steam exiting the desuperheater 16 is controlled via a flow control circuit that receives output from the temperature sensor 22 and selectively delivers the cooled steam to the condenser 26 or the LP steam turbine 28, depending on the temperature of the cooled steam. The flow control circuit 24 includes a condenser path isolation valve 30 and a turbine path isolation valve 32. The condenser path isolation valve 30 is selectively opened to direct the cooled steam to the condenser 26, and the turbine path isolation valve 32 is selectively opened to direct the cooled steam to the LP turbine 28.

As shown, the flow control circuit 24 additionally includes a parallel flow split 33 upstream of the LP turbine 28. The cooled steam directed to the LP turbine 28 is divided by the parallel flow split 33 and coincidentally provided to a top and bottom of the LP turbine 28. A second temperature sensor 34 preferably includes a pair of thermocouples positioned at the top and bottom of the LP turbine, respectively. The second temperature sensor 34 detects water droplets at the turbine inlet. If water is detected, the flow is routed back to the condenser.

Figure 2:
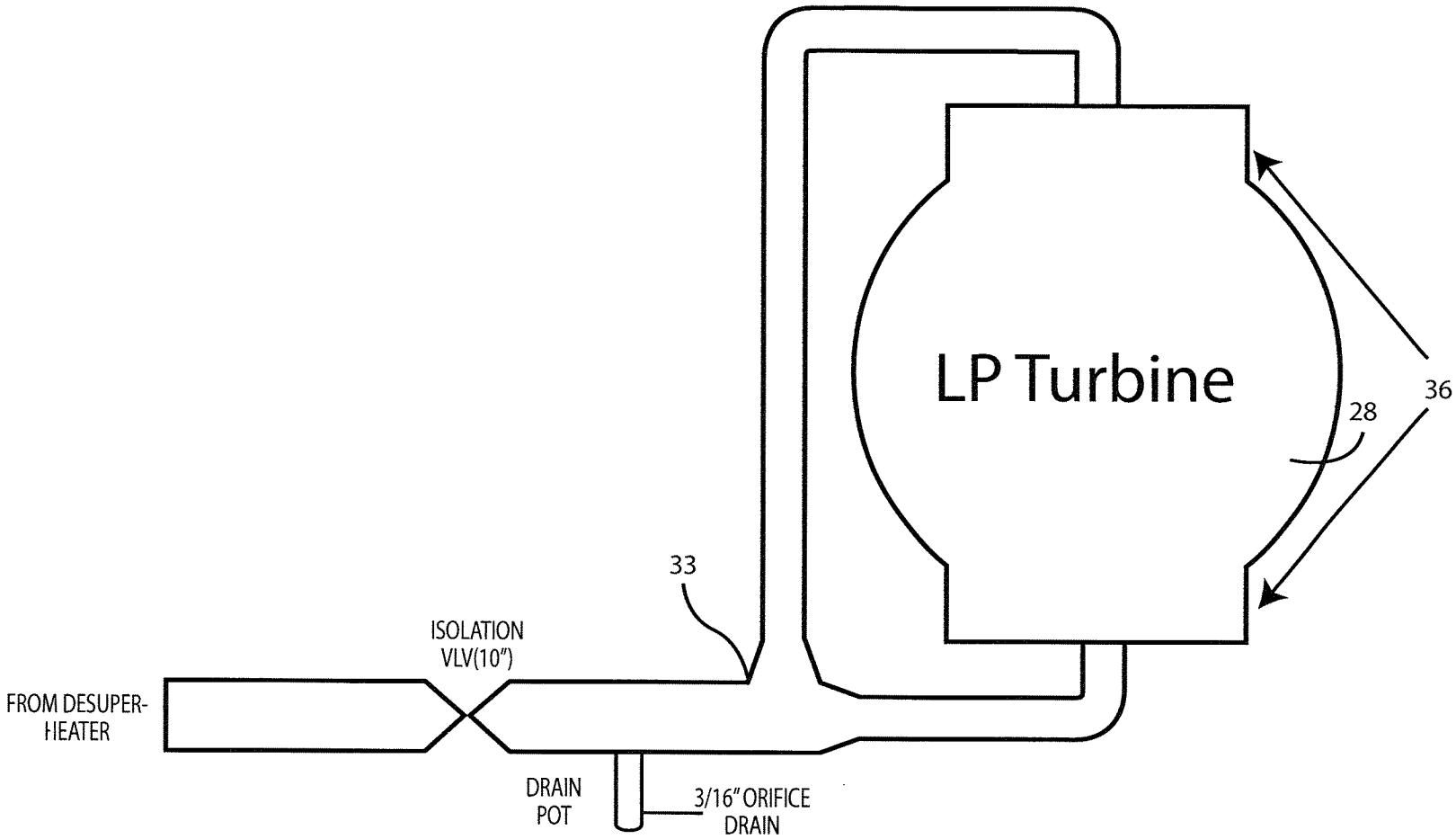
FIG. 2 is a close-up view of the piping at the LP turbine connection.

FIG. 2 is a close-up view of the piping at the LP turbine connection. The parallel flow split 33 brings the steam into the top and bottom of the turbine for balanced flow. Admission boxes 36 are built on the outside of the turbine casing for controlling input of the cooled steam.

In operation, on turbine start-up, the steam seal dump flow is initially routed to the condenser 26. Until the system achieves self-sealing, steam may be added to the steam seal header 12 via the feed valve 14. When appropriate permissives are met (e.g., minimum flow rate, self-sealing), the control valve 20 is opened to supply condensate to the desuperheater 16. The dump flow remains routed to the condenser 26 until the temperature of the steam exiting the desuperheater 16 stabilizes. That is, the condenser path isolation valve 30 is opened and the turbine path isolation valve 32 is closed to route the dump flow to the condenser 26. Once the temperature permissive is met, the isolation valves 30, 32 are switched to transfer the dump flow to the inlets of the LP turbine 28. The system continuously checks to be sure that the permissives are met, and if any of the permissives are lost during operation, the system automatically diverts the dump flow back to the condenser via the isolation valves 30, 32 to protect the turbine.

In one design, the steam turbine performance increase for the dump re-entry system was estimated at 200-250 kW. The performance benefit of the system increases over time as the end packing teeth wear and leakage flow increases. Of course, the system is applicable to any steam turbine type.

While the invention has been described in connection with what is presently considered to be the most practical and preferred embodiments, it is to be understood that the invention is not to be limited to the disclosed embodiments, but on the contrary, is intended to cover various modifications and equivalent arrangements included within the spirit and scope of the appended claims.

What is claimed is:

1. A method for delivering steam dump flow to a condenser or an LP steam turbine, the method comprising:

(a) initially routing the steam dump flow to the condenser;

(b) when a first predetermined permissive is met, cooling the steam dump flow in a desuperheater, the desuperheater outputting cooled steam;

(c) after step (b), routing the cooled steam to the condenser until a temperature of the cooled steam is stable, the stability of the cooled steam temperature defining a second predetermined permissive;

(d) when the second predetermined permissive is met, routing the cooled steam to inlets of the LP steam turbine where the cooled steam can expand and do work; and (e) determining whether the second permissive is met by detecting a temperature of the cooled steam.

2. A method according to claim 1, further comprising repeatedly detecting that the second predetermined permissive is met, and if not, the method comprising re-routing the cooled steam to the condenser.

3. A method according to claim 1, wherein step (b) is practiced by inputting condensate from a condensate supply into the desuperheater.

4. A method according to claim 3, wherein step (b) is further practiced by controlling an amount of the condensate input into the desuperheater based on a temperature of the cooled steam exiting the desuperheater.

* * * * *

UNITED STATES PATENT AND TRADEMARK OFFICE

CERTIFICATE OF CORRECTION

PATENT NO. : 8,689,557 B2
APPLICATION NO. : 13/021039
DATED : April 8, 2014
INVENTOR(S) : Maki et al.

It is certified that error appears in the above-identified patent and that said Letters Patent is hereby corrected as shown below:

In the Specification

Column 2, line 43, insert --16-- after "desuperheater"

Column 3, line 20, insert --24-- after "flow control circuit"

Column 4, line 9, insert --26-- after "condenser"

Signed and Sealed this
Twenty-ninth Day of July, 2014

Michelle K. Lee

Michelle K. Lee
*Deputy Director of the United States Patent and Trademark Office*